US009897403B2

(12) United States Patent
Kedairy

(10) Patent No.: US 9,897,403 B2
(45) Date of Patent: Feb. 20, 2018

(54) RECOIL ATTENUATING MECHANISM FOR A FIREARM

(71) Applicant: Skychase Holdings Corporation, Alachua, FL (US)

(72) Inventor: Faisal Kedairy, Vienna (AT)

(73) Assignee: Skychase Holdings Corporation, Alachua, FL (US)

( * ) Notice: Subject to any disclaimer, the term of this patent is extended or adjusted under 35 U.S.C. 154(b) by 0 days.

(21) Appl. No.: 15/049,728

(22) Filed: Feb. 22, 2016

(65) Prior Publication Data

US 2016/0245601 A1 Aug. 25, 2016

Related U.S. Application Data

(60) Provisional application No. 62/119,547, filed on Feb. 23, 2015.

(51) Int. Cl.

| | |
|---|---|
| ***F41A 21/00*** | (2006.01) |
| ***F41A 3/86*** | (2006.01) |
| ***F41A 5/10*** | (2006.01) |
| ***F41A 27/30*** | (2006.01) |
| ***F41C 27/22*** | (2006.01) |

(52) U.S. Cl.
CPC *F41A 3/86* (2013.01); *F41A 5/10* (2013.01); *F41A 27/30* (2013.01); *F41C 27/22* (2013.01)

(58) Field of Classification Search
USPC ..... 42/1.06; 9/194, 195, 196, 197
See application file for complete search history.

(56) References Cited

U.S. PATENT DOCUMENTS

| | | | | |
|---|---|---|---|---|
| 580,924 | A | 4/1897 | Browning | |
| 2,259,569 | A | 10/1941 | King | |
| 3,491,650 | A | 1/1970 | Rohr | |
| 4,986,018 | A | 1/1991 | McDonald | |
| 6,293,203 | B1 | 9/2001 | Alexander et al. | |
| 9,194,650 | B2 * | 11/2015 | Hangen | F41A 5/10 |

(Continued)

FOREIGN PATENT DOCUMENTS

| | | | |
|---|---|---|---|
| AT | 319816 | B | 1/1975 |
| DE | 20004198 | U1 | 7/2000 |

(Continued)

OTHER PUBLICATIONS

International Search Report of ISA/EP, dated Apr. 13, 2016, for PCT/AT2016/050036.

(Continued)

*Primary Examiner* — John W Eldred
(74) *Attorney, Agent, or Firm* — Whitmyer IP Group LLC

(57) ABSTRACT

The present invention relates to firearms, especially to guns, and more particularly to a system for attenuating recoil, reducing muzzle climb and increasing accuracy. The invention provides a recoil attenuating mechanism that is an improvement on the well-known and widely used Browning tilting barrel system which is used mostly in semi-automatic pistols. The recoil attenuation is achieved by redirecting and manipulating the forces of the recoil of the slide of the pistol to a different axis than what is the norm on a regular Browning action, thus reducing muzzle climb substantially in addition to attenuating recoil, and therefore improving accuracy, recovery time, and controllability.

21 Claims, 3 Drawing Sheets

(56) References Cited

U.S. PATENT DOCUMENTS

| | | | | |
|---|---|---|---|---|
| 2010/0077643 | A1* | 4/2010 | Kerbrat | F41A 3/06<br>42/1.06 |
| 2014/0075799 | A1 | 3/2014 | Hangen | |
| 2015/0247697 | A1 | 9/2015 | Hangen | |
| 2016/0047613 | A1 | 2/2016 | Hudson et al. | |

FOREIGN PATENT DOCUMENTS

| | | | |
|---|---|---|---|
| WO | 2005008167 | A9 | 3/2005 |
| WO | 2010041220 | A1 | 4/2010 |

OTHER PUBLICATIONS

International Search Report of ISA/EP, dated May 25, 2016, for PCT/AT2016/050037.

* cited by examiner

RECOIL ATTENUATING MECHANISM FOR A FIREARM

FIELD OF THE INVENTION

The present invention relates to firearms, especially to guns, and more particularly to a system for attenuating recoil, reducing muzzle climb, and increasing accuracy during and after firing (shooting) a bullet.

BACKGROUND OF THE INVENTION

The Browning tilting barrel recoil mechanism was invented by J. M. Browning and patented on Apr. 29, 1897, U.S. Pat. No. 580,924 entitled Firearm. Since that time this system has become the most wildly used recoil system in automatic pistols. With various modifications, it is currently used by most of the major pistol makers such as in the Colt 1911, F N browning High Power, Smith and Wesson pistols, Glock, Heckler & Koch, Ruger, C. Z., Tanfoglio and many others. It is a state-of-the-art mechanism (cf. FIGS. 3*a*-3*c*), which works by a slide moving backwards and/or recoiling on an axis 32 above the axis 33 of the center of mass 31 of the pistol (see FIG. 3*a*) while at the same time the barrel tilts upward from the muzzle end, and down and backwards on the chamber/breach face end. Furthermore, the gases created during the combustion action of the powder in the barrel will move the muzzle part of the gun in the direction of least resistance, which usually means that it causes a pronounced muzzle climb during the recoil action of the pistol after a shot is fired (cf. FIGS. 3*b* and 3*c*), especially where the pistol is chambered with a modern high energy caliber. This renders the pistol less controllable and less accurate than desired. Controllability and accuracy are traits which are highly desirable in firearms with shorts barrels such as pistols. In addition, due to the generally preferable relatively small size of automatic pistols, a significant increase in mass to counter the recoil action is generally not easily attainable and is undesirable.

The Browning tilting barrel recoil mechanism is a well-known mechanism in the state of the art literature, see for instance: A History of Handguns, by Frederick Wilkinson, The Crowood Press UK (15 Feb. 2011); The Illustrated Encyclopedia of Pistols, Revolvers and Submachineguns, by Will Fowler, Anthony North, Charles Stronge, J G Press (1 Aug. 2010); and The Complete Encyclopedia of Pistols and Revolver, by A. E. Haraink, Book Sales/Chartweil Books (3 Jan. 2013).

Many developments and design modifications have been attempted over the years to reduce or compensate for this muzzle climb action of the Browning system. Examples include, but are not limited to: adding Muzzle breaks and ported barrels that redirect the Gases upwards from the muzzle; adding static weight modules to the front part of the frame, or to the muzzle of the barrel; providing compensating bushings at the muzzle that control the free movements of the barrel; and pedals/thumb rests that shooters would use to press the Pistol downwards while firing to limit the climb. Different kinds of shock absorber systems that use springs or hydraulic cylinders have also been attempted in addition to many buffering systems that use rubber or plastic buffers in an attempt to attenuate recoil. These systems work in varying degrees of efficiency, but each has its major drawbacks. One example of such a system is the muzzle break: while well designed muzzle brake systems can effectively limit muzzle Climb, they render the pistol very loud, with a significant flash in front of the front sight, not to mention a significant added weight and bulk on the front top end of the pistol. This makes the pistol cumbersome to use, and basically limits the use of this system to organized sporting competitions.

Other designers have attempted to eliminate the problem by using completely different recoil mechanisms, for instance rotating barrels as opposed to tilting barrels, such as those on the Walther P38 or the Beretta 92, using gas recoil systems such as on the Desert Eagle, or gas-delayed blowback systems such as on the H&K P7, with stationary barrels. However, the vast majority of automatic pistols today still use the Browning system due to its simplicity of manufacture and maintenance, and the ability to interchange the major parts of the pistol such as the barrel and slide with very little complications.

SUMMARY OF THE INVENTION

The subject of the present invention is a recoil attenuating mechanism that is an improvement on the well-known and widely used Browning tilting barrel system which is used mostly in semi-automatic pistols. The recoil attenuation is achieved by redirecting and manipulating the forces of the recoil of the slide of the pistol to a different axis than what is the norm on a regular Browning action, and thus reducing muzzle climb substantially in addition to attenuating recoil. The results are improved accuracy, recovery time, and controllability. The present invention is aimed at overcoming the drawbacks of the prior art described above.

Using the traditional Browning tilting barrel system as a starting point, the present invention substantially and significantly modifies the recoil handling mechanism. More specifically, in a recoil attenuating system according to the present invention, the axis of the recoiling mass is lowered below the center of the mass of the firearm. This may also involve extending and lowering the point at which the barrel connects to the lower position of the spring rod and the recoil spring assembly mechanism. This modification may be combined with the addition of a mobile weight attachment that is able to move with the action of said recoil spring assembly mechanism. This action greatly enhances the compensation effect of the redirection of the recoil forces by acting as a reverse cantilever.

By arranging the axis of the recoiling mass below the axis of the center of the mass of the pistol, this results in a lower muzzle climb during and after firing, and attenuated recoil due to a more uniform distribution of the recoil forces, which are now directed also below the center of the mass of the pistol and to lower part of the frame. This is opposed to the prior art, where the main forces of the recoil are concentrated and directed to the upper part of the slide and thus in pushing the muzzle upwards and backwards. This new action that is now redirected on the part of the pistol that is located at and below the center of the mass axis creates a backward and downward action force that will limit muzzle climb and redistribute the recoil forces to lower parts of the pistol frame.

Moreover, another aspect of the invention relates to a method for recoil attenuation, which comprises redirecting and manipulating the forces of the recoil of the slide of the pistol to a different axis than what is the norm on a regular Browning action, and thus reducing muzzle climb substantially in addition to attenuating recoil.

BRIEF DESCRIPTION OF THE DRAWINGS

In the following, the present invention is described in more detail with reference to the drawings, in which.

DETAILED DESCRIPTION OF EMBODIMENTS OF THE INVENTION

FIGS. 2 and 4*a*-4*c* illustrate a firearm of the Browning type according to the present invention according to an exemplary and non-restrictive embodiment, as compared to corresponding drawings of a firearm of the prior art depicted in FIGS. 1 and 3*a*-3*c*. It will be evident to the person skilled in the art to freely combine several or all of the different aspects of the embodiment discussed here and/or described in the claims as will be deemed suitable for a specific implementation of the invention. Throughout this disclosure, terms like "advantageous", "exemplary" or "preferable" indicate elements or qualities which are particularly suitable (but not essential) to the invention or an embodiment thereof and which may be modified wherever deemed suitable by the skilled person, except where expressly required.

Figure 2:
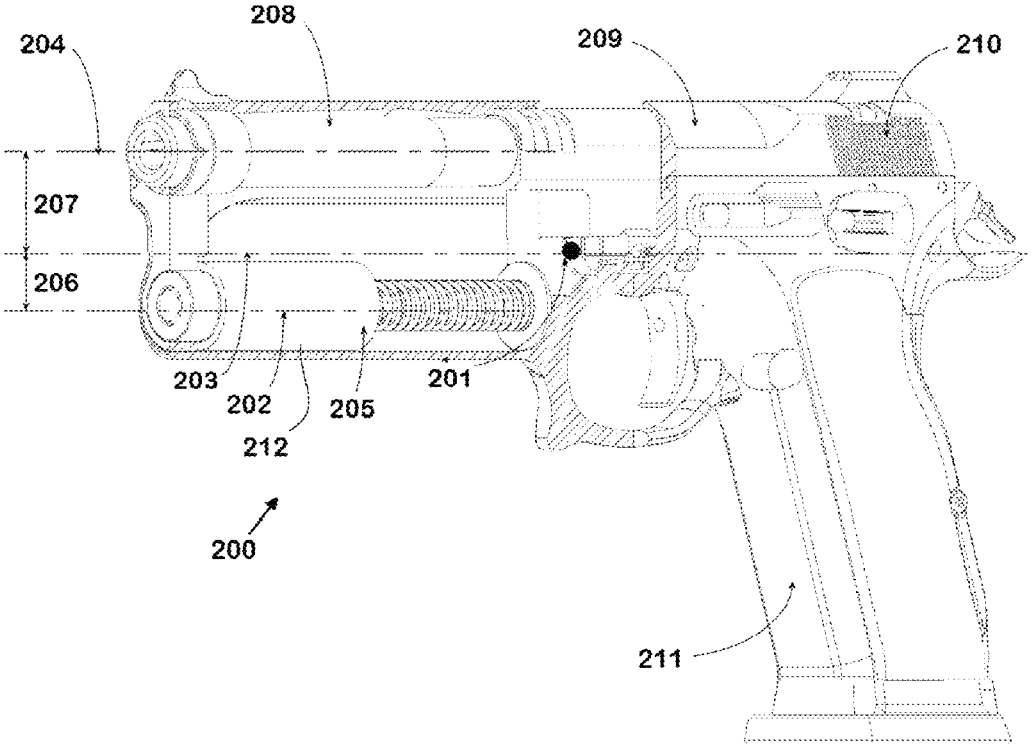
FIG. 2 is a perspective view of the firearm with the center of mass according to the present invention.

Referring to FIG. 2, a pistol 200 according to an embodiment of the invention is shown in a perspective view. The center of the mass of the pistol 200 is denoted by a dot 201. The pistol 200 comprises a frame 211, a barrel 208 with barrel axis 204, and a slide 209. The barrel axis 204 is preferably located in the upper part of the pistol 200, at a height 207 above the axis 203 running parallel through the center of mass ("center of mass axis", CMX). The slide 209 comprises a heavy back part 210, which preferably is located above the CMX 203, and the recoil attenuating system 205. The back part 210 generally has a heavier weight than the front part of the slide 209, which comprises the recoil attenuating system 205. The recoil attenuating system 205 is located below the center of mass 201. More precisely, the axis 202 ("recoil axis") of the recoil attenuating system 205 is located below the parallel CMX 203 spaced at a distance 206 (which has a negative value if measured in a coordinate system relative to the center of mass 201).

Figure 1:
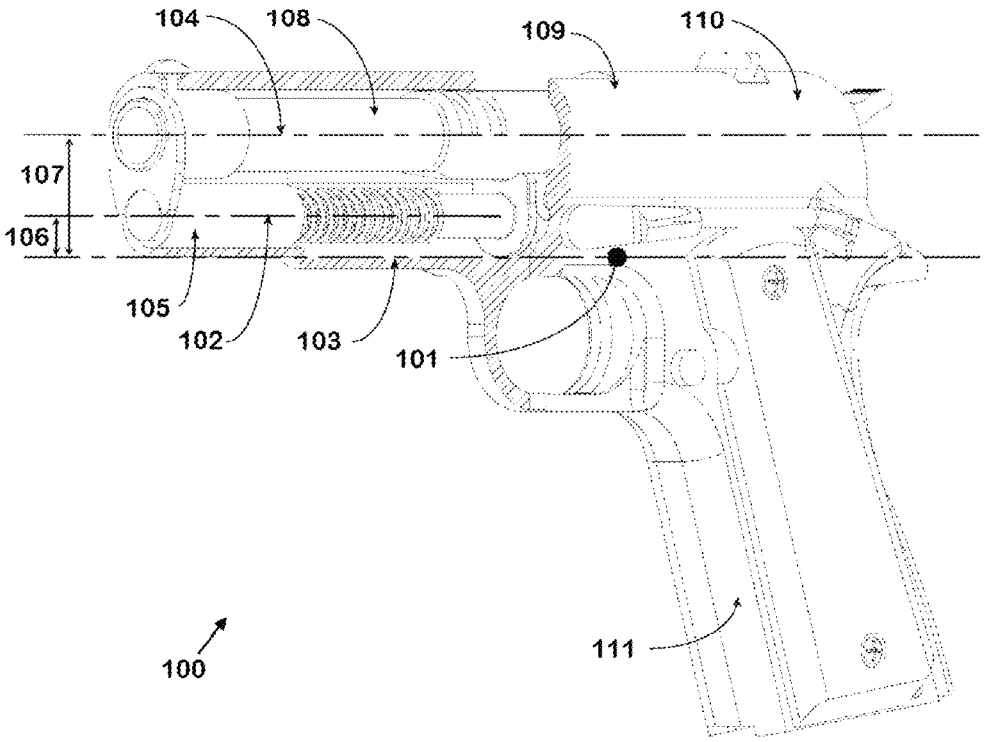
Fig. 1 (PRIOR ART)
FIG. 1 is a perspective view of a firearm with the center of mass according to the prior art.

FIG. 1 shows a pistol 100 according to the prior art, comprising a frame 111, a barrel 108 with barrel axis 104, as well as a slide 109 having a heavy back part 110. In the prior-art pistol 100 the center of mass 101 is usually below the recoil axis 102 of the recoil assembly system 105. Thus, the height 106 of the recoil axis 102, when measured relative to the center of the mass axis 103, has a positive value, and falls within the height 107 of the barrel axis 104 of the barrel 108.

Figure 3A:
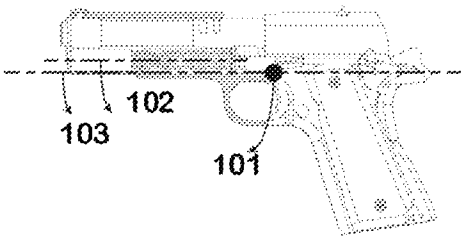
Fig. 3a (PRIOR ART)
FIGS. 3*a*-3*c* are side views to illustrate firing recoil forces and reaction with the prior art firearm of FIG. 1 in a sequence of positions, namely, FIG. 3*a* in a static position, FIG. 3*b* in a first firing position, and FIG. 3*c* in a second firing position.
Figure 3B:
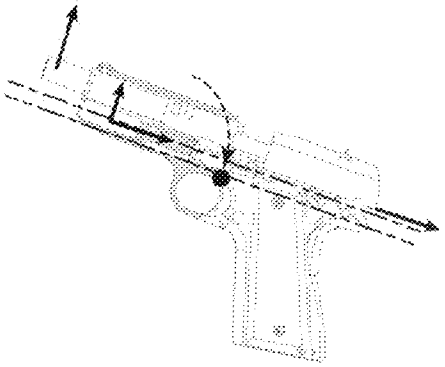
Fig. 3b (PRIOR ART)
Figure 3C:
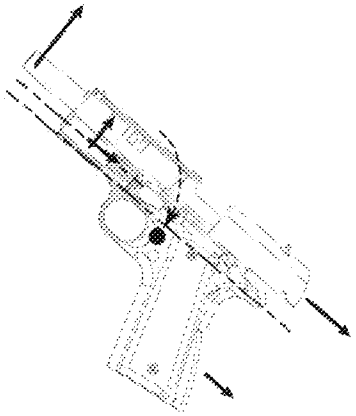
Fig. 3c (PRIOR ART)
Figure 4A:
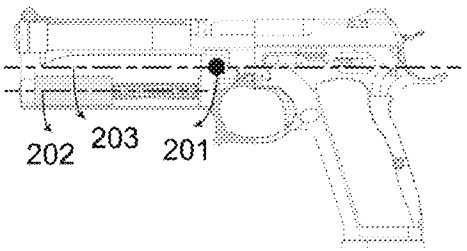
FIGS. 4*a*-4*c* are side views to illustrate firing recoil forces and reaction of the firearm of the present invention (FIG. 2), in a like sequence of positions, namely, FIG. 4*a* in a static position, FIG. 4*b* in a first firing position, and FIG. 4*c* in a second firing position.
Figure 4B:
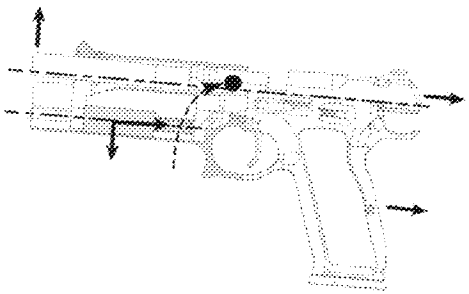
Figure 4C:
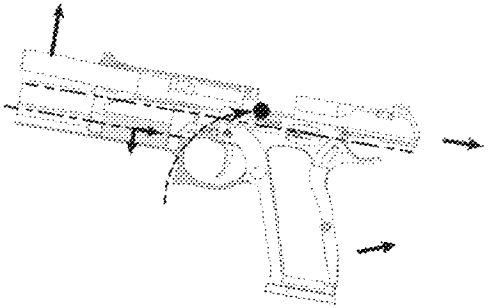

Referring to FIG. 4*a*, by virtue of the present invention the axis 202 of the recoiling mass ("recoil axis") is below the axis 203 of the center of the mass 201 of the pistol. This results in a lower muzzle climb during and after firing, and attenuated recoil due to a more uniform distribution of the recoil forces which are now being directed also to the lower part of the frame and below the center of the mass axis 203, and this creates mostly backward and downward action forces as illustrated in FIGS. 4*b* and 4*c*. In contrast, as shown in FIG. 3*a*, in the prior art the axis 102 of the recoiling mass is usually above the axis 103 of the center of the mass 101, and is mostly directed to the upper part of the slide and backwards and upwards, which causes considerable muzzle climb upon firing the pistol, as illustrated in FIGS. 3*b* and 3*c*. In FIGS. 3*a*-3*c* and FIGS. 4*a*-4*c*, dark arrows denote directions of forces, while dashed arrows indicate the centers of mass movement direction.

In some embodiments according to the present invention, an extra weight 212 is added to the lower front lowest part of the slide 209 (see FIG. 2), preferably in a way that it is part of the front part of the spring rod assembly mechanism of the pistol. This extra weight 212 located at or below the axis 202 of the recoil attenuating system 205 counteracts the muzzle climb action by acting as a reverse cantilever to the heavy back part 210 of the slide 209. Thus, the extra weight 212 further decreases muzzle climb (cf. FIGS. 4*b*-4*c*) and redirects the recoil forces backwards and downwards instead of backwards and upwards as compared to a firearm made in accordance with the prior art (cf. FIGS. 3*b*-3*c*).

The invention claimed is:

1. A pistol comprising:
a frame;
a slide adapted to reciprocate with respect to the frame;
the pistol having a center of mass on a horizontal center of mass axis;
the slide having an upper portion above the center of mass axis;
the slide having a weight element connected to the upper portion of the slide; and
the weight element having an upper surface below the center of mass axis.

2. The pistol of claim 1 wherein including a guide rod connected to the frame and encompassed by a recoil spring, the weight element defining a passage receiving the guide rod.

3. The pistol of claim 2 where the weight element encompasses at least a portion of the recoil spring.

4. The pistol of claim 1 wherein the entire recoil spring is below the center of mass axis.

5. The pistol of claim 1 wherein the slide has a connection portion connected to the upper portion of the slide at a forward end of the upper portion, depending downwardly from the upper portion, and having a free end connected to the weight element.

6. The pistol of claim 1 wherein the upper portion of the slide and the weight element each have respective forward end portions, and are spaced apart from each other except at their forward end portions.

7. The pistol of claim 1 wherein the weight element is a tubular body.

8. The pistol of claim 1 wherein the weight element is an elongated body.

9. The pistol of claim 1 wherein the weight element is a cylindrical body.

10. The pistol of claim 1 wherein the upper portion of the slide has a back portion and a front portion, and wherein the back part is heavier than the front part.

11. The pistol of claim 10 wherein the front part is aft of a midpoint of the slide.

12. The pistol of claim 1 wherein the entire weight element is below the center of mass axis.

13. A pistol comprising:
a frame;
a slide adapted to reciprocate with respect to the frame;

a guide rod connected to the frame;

a recoil spring about the guide rod and interposed between the frame and the slide;

the pistol having a center of mass on a horizontal center of mass axis;

the slide having an upper portion above the center of mass axis;

the slide having a tubular weight element connected to the upper portion of the slide;

the weight element defining a passage receiving the guide rod;

the weight element being entirely below the center of mass axis.

14. The pistol of claim 13 wherein the weight element is a tubular body.

15. The pistol of claim 13 wherein the weight element is an elongated body.

16. The pistol of claim 13 wherein the weight element is a cylindrical body.

17. The pistol of claim 13 wherein the entire recoil spring is below the center of mass axis.

18. The pistol of claim 13 wherein the slide has a connection portion connected to the upper portion of the slide at a forward end of the upper portion, depending downwardly from the upper portion, and having a free end connected to the weight element.

19. The pistol of claim 13 wherein the upper portion of the slide and the weight element each have respective forward end portions, and are spaced apart from each other except at their forward end portions.

20. The pistol of claim 13 wherein the upper portion of the slide has a back portion and a front portion, and wherein the back part is heavier than the front part.

21. A pistol comprising:

a frame;

a slide adapted to reciprocate with respect to the frame;

the pistol having a center of mass on a horizontal center of mass axis;

the slide having an upper portion above the center of mass axis;

the slide having a weight element connected to the upper portion of the slide; and the weight element having a tubular upper surface below the center of mass axis.

* * * * *